United States Patent [19]

Lyon

[11] 4,184,617

[45] Jan. 22, 1980

[54] SURVIVAL BELT

[76] Inventor: Edwin Lyon, 944 Buttermilk Creek Dr., Fond du Lac, Wis. 54935

[21] Appl. No.: 922,554

[22] Filed: Jul. 7, 1978

[51] Int. Cl.[2] ..... A45C 1/04

[52] U.S. Cl. ..... 224/151; 224/234; 24/3 R

[58] Field of Search ..... 224/5 R, 5 A, 5 H, 5 MC, 224/5 T, 5 V, 26 R, 26 E, 26 B, 2 R, 2 B, 2 E, 2 F, 1 R; 2/312; 24/3 R, 3 F

[56] References Cited

U.S. PATENT DOCUMENTS

| | | | |
|---|---|---|---|
| 1,558,228 | 10/1925 | Botkin | 224/5 R |
| 1,617,600 | 2/1927 | Kirsch | 224/5 A |
| 2,302,997 | 11/1942 | Lucas | 224/5 R |
| 2,958,448 | 11/1960 | Leclerc | 224/1 R |

*Primary Examiner*—Joseph J. Rolla
*Assistant Examiner*—Kenneth Noland

[57] ABSTRACT

A survival belt including in combination a first belt portion, a hatchet head having a body with a cutting edge, and the body having a chamber therein, and a second belt portion for supporting the hatchet head. The survival belt further includes devices for releasably connecting the first and second belt portions, and a third belt portion defined by a rope through holes in the first belt portion and through holes in the second belt portion. The survival belt also includes a plurality of survival implements contained in the hatchet head chamber, the survival implements including a compass, a metallic match, a fish hook and line and metallic foil.

14 Claims, 4 Drawing Figures

SURVIVAL BELT

BACKGROUND OF THE INVENTION

The present invention relates to sporting equipment and more particularly to a survival belt to be worn as a belt by hunters, hikers, campers or other outdoorsmen, and provides survival implements to be used for emergency survival.

Outdoorsmen should carry emergency equipment for use in maintaining life in the wilderness in the event of a mishap or accident. Such emergency equipment should provide all of the items which will be needed to sustain life but should not be unduly heavy or cumbersome, and those items of emergency equipment which must be carried should be assembled such that they are conveniently carried.

SUMMARY OF THE INVENTION

The present invention includes a survival belt which can be conveniently worn as a belt and which includes a plurality of items necessary to sustain life in the wilderness. The belt is particularly constructed to be lightweight and conveniently carried by the wearer.

The survival belt includes a first belt portion and a hatchet head having a cutting edge and a chamber in the body of the hatchet head. The survival belt further includes a second belt portion for supporting the hatched heat and buckling means for releasably connecting the first belt portion and the second belt portion. A third belt portion joins the first and second belt portions and is comprised of a plurality of lengths of rope attached to the first belt portion and to the second belt portion.

In accordance with one embodiment of the invention, the second belt portion includes a flexible member and means for securing the hatchet head against the flexible member, the means for securing including a sheath means for housing the cutting edge.

One of the principal features of the invention is the provision of a plurality of survival tools held in the chamber in the hatchet head. The survival tools include a compass, a metallic match, a fish hook, fish line, aspirin, and metal foil.

One of the advantages of the invention is that nearly all of the components of the belt are functional and necessary survival items and very little additional weight is added by nonfunctional elements. Furthermore, the survival belt of the invention is conveniently worn and easy to carry and provides sufficient tools for the outdoorsman to maintain himself in the wilderness for extended periods of time.

GENERAL DESCRIPTION

Figure 1:
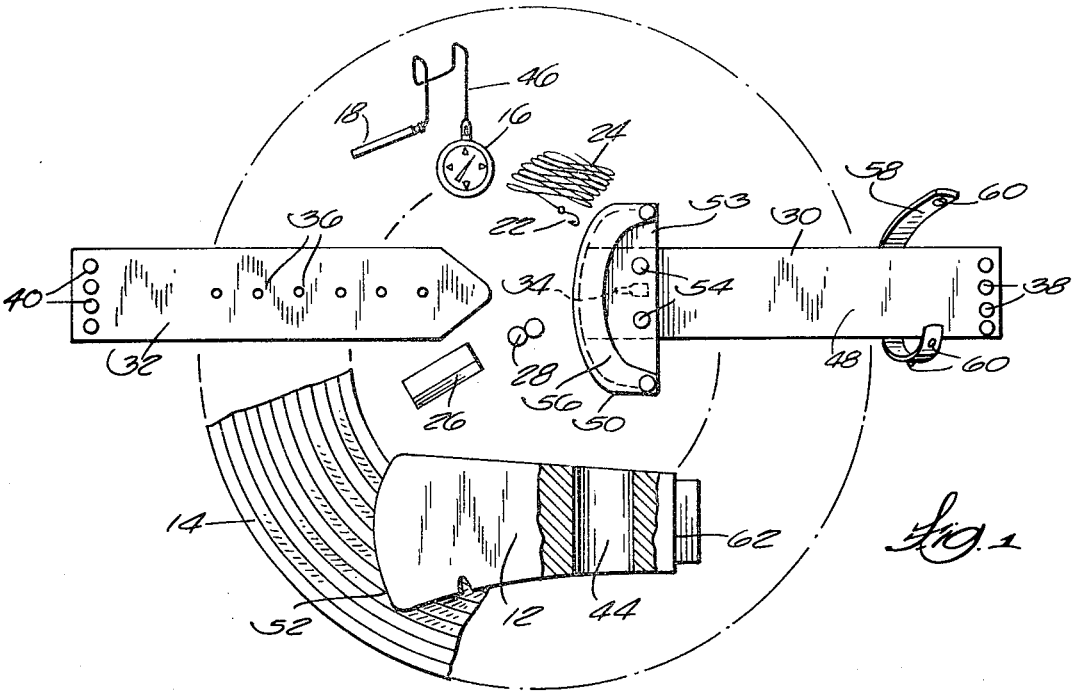
FIG. 1 is a perspective view of the components of the survival belt of FIG. 1, the components being disassembled.

The survival belt 10 of the invention provides a means for conveniently carrying a plurality of survival implements for use by an outdoorsman, and as shown in FIG. 1, such impelements include a hatchet head 12, a rope 14, a compass 16, a metallic match 18, a fish hook 22, a fish line 24, metallic foil 26, and aspirin tables 28.

Figure 3:
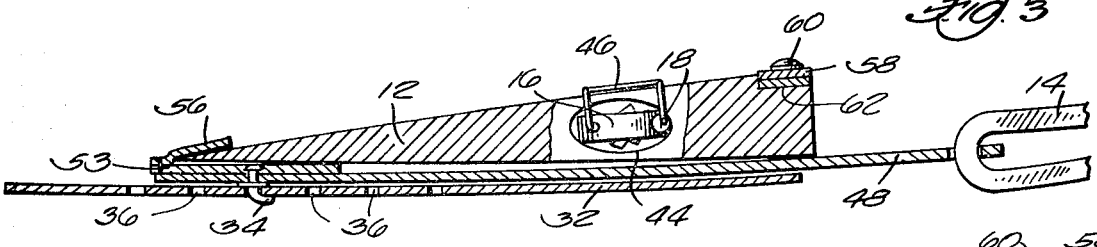
FIG. 3 is a cross-section view taken along line 3—3 in FIG. 2.
Figure 2:
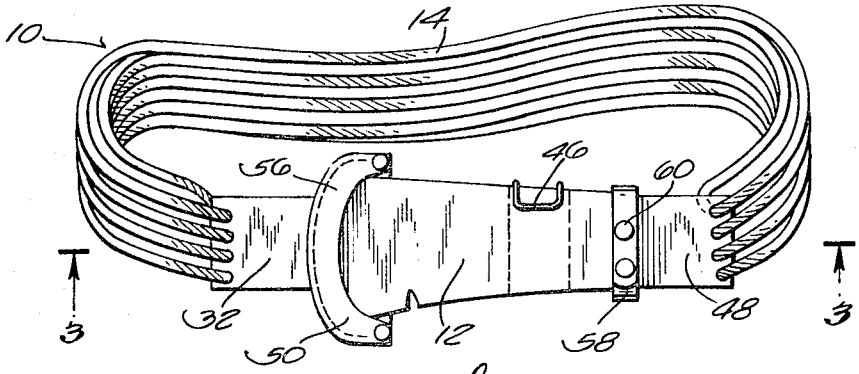
FIG. 2 is a perspective view of a survival belt embodying the invention and in assembled relation.

As shown in FIG. 2, these implements can be supported in the form of a belt such that they can be conveniently carried. The hatchet head 12 is supported by a belt portion which functions as a hatchet head holder member 30. The hatchet head holder member 30 can be connected with a flexible belt portion 32 by a hook 34 (FIG. 3) extending from the rear surface of the hatchet head holder member 30 and selectively engageable with one of a plurality of apertures 36 in the flexible belt portion 32. The hatchet head holder member 30 and the flexible belt portion 32 include a plurality of holes 38 and 40 therethrough, respectively, such that the rope 14 can be reeved though the holes 38 and 40, as shown in FIG. 2, to form an intermediate belt portion of the survival belt 10 joining the hatchet head holder member 30 and the belt portion 32. The opposite ends of the rope 14 are knotted to prevent them from being pulled through the holes 38 and 40.

The hatchet head 12 includes a conventional cavity 44 therethrough commonly intended to house the end of a hatchet handle. When the hatchet head 12 is supported by the hatchet head holder member 30, the compass 16, metallic match 18, fish hook 22, fish line 24, metallic foil 26 and aspirin tablets 28 can be conveniently wedged into the cavity 44 and stored therein. The compass 16 and the metallic match 18 are further restrained in the cavity 44 by a spring clip 46 which clips onto the edge of the hatchet cavity 44. The metallic foil 26 is intended to provide a container for the aspirin tablets 28 and is also functional as a drinking cup and reflector. It should be recognized that additional small survival implements such as a snare line could also be wedged into the cavity 44.

In the preferred embodiment, the hatchet head holder member 30 is comprised of leather, but other materials, including but not limited to plastic, fabric, vinyl, rubber or metal, could also be used. The hatchet head holder member 30 includes an elongated thin rectangular flexible member 48 having opposite ends, one of the opposite ends supporting a sheath 50 provided to restrain the hatchet head 12 and to protect and house the cutting edge 52 of the hatchet head. The sheath 50 is comprised of a first panel 53 secured by rivets 54 to one end of the flexible member, the panel 53 having a curved surface which is complementary to the curved cutting edge 52 of the hatchet head. The sheath 50 further includes a crescent shaped panel 56 stitched to the first panel 53 to form an envelope therebetween for receiving the cutting edge 52 of the hatchet head 12. The hatchet head holder member 30 also includes a flexible loop 58 for engaging the butt end of the hatchet head 12 and for securing it against the flexible substrate 48. The flexible loop 58 includes a pair of free ends having complementary mating snap means 60 whereby the free ends can be joined together.

Figure 4:
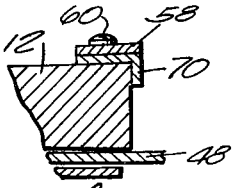
FIG. 4 is a cross-section view similar to a portion of FIG. 3 and showing an alternative embodiment of the invention.

An alternative means for securing the hatchet head 12 against the hatchet head holder member 30 is shown in FIG. 4. In that embodiment the flexible loop 58 is further provided with a restraining strap 70 positioned against the butt end of the hatchet head 12 to prevent the hatchet head blade from sliding out of the sheath 50.

I claim:

1. A survival belt to be worn about the waist including in combination a first belt portion, a second belt portion, a hatchet head supported by one of said belt portions, said hatchet head having a body with a cutting edge and said body having a chamber therein a plurality of survival implements supported by and contained within said chamber, means for releasably connecting said first belt portion and said second belt portion, and a third belt portion solely joining said first and second belt portions at an end of each of said belt portions and including a rope reeved between and through said first belt end and said second belt end.

2. The survival belt set forth in claim 1 wherein said second belt portion includes a sheath means for housing a portion of said hatchet head.

3. The survival belt set forth in claim 1 wherein said means for releasably connecting said first belt portion and said second belt portion includes a hook extending from one of said first and second belt portions and the other of said first and second belt portions includes an aperture for receiving said hook.

4. A survival belt to be worn about the waist including in combination a first belt portion, a second belt portion, a hatchet head supported by one of said belt portions, said hatchet head having a body with a cutting edge and said body having a chamber therein, means for releasably connecting said first belt portion and second second belt portion, a third belt portion including a rope reeved between said first belt portion and said second belt portion, and a plurality of survival implements positioned in said chamber, said implements including a compass, a metallic match and a fish hook.

5. A survival belt to be worn about the waist including in combination a first belt portion having opposite ends and including a plurality of spaced holes through one of said ends, a second belt portion including a plurality of spaced holes therein, a hatchet head supported by one of said belt portions, said hatchet head having a body with a cutting edge and said body having a chamber therein, a plurality of survival implements supported by and contained within said chamber, means for releasably connecting said first belt portion and said second belt portion, and a third belt portion including a rope reeved through said holes in said first belt portion and through said holes in said second belt portion to connect said first and second belt portions.

6. The survival belt set forth in claim 5 wherein said second belt portion includes a sheath means for housing a portion of said hatchet head 7. The survival belt set forth in claim 5 wherein said means for releasably connecting said first belt portion and said second belt portion includes a hook extending from one of said first and second belt portions and the other of said first and second belt portions includes an aperture for receiving said hook.

8. A survival belt to be worn about the waist including in combination a first belt portion having opposite ends and including a plurality of spaced holes through one of said ends, a second belt portion including a plurality of spaced holes therein, a hatchet head supported by one of said belt portions, said hatchet head having a body with a cutting edge and said body having a chamber therein, means for releasably connecting said first belt portion and said second belt portion, a third belt portion including a rope reeved through said holes in said first belt portion and through said holes in said second belt portion to connect said first and second belt portions, and a plurality of survival implements positioned in said chamber.

9. The survival belt set forth in claim 8 wherein said survival implements comprise a compass.

10. The survival belt set forth in claim 8 wherein said survival implements comprise a fish hook and line.

11. The survival belt set forth in claim 8 wherein said survival implements comprise a metallic match.

12. The survival belt set forth in claim 8 wherein said survival tools include a compass, a fish hook, line and metallic match.

13. A survival belt to be worn about the waist including in combination a flexible belt portion having opposite ends and including a plurality of spaced holes through one of said ends and at least one aperture spaced from said plurality of spaced holes, a hatchet head having a cutting edge and a body having a chamber therein a plurality of survival implements supported by and contained within said chamber, a hatchet head holder for supporting said hatchet head and including a flexible member having opposite ends, and a plurality of spaced holes in one of said opposite ends, and said hatchet head holder also including means for securing said hatchet head to said flexible member, said securing means including sheath means for housing said cutting edge, means for releasably connecting said flexible belt portion and said hatchet head holder, said connecting means including a hook connected to said flexible member and engageable with said aperture, and a rope attached to said flexible belt portion and to said hatchet head holder, said rope being reeved through said plurality of spaced holes in said flexible belt portion and through said plurality of spaced holes in said flexible member.

14. A survival belt to be worn about the waist including in combination a flexible belt portion having opposite ends and including a plurality of spaced holes through one of said ends and at least one aperture spaced from said plurality of spaced holes, a hatchet head having a cutting edge and a body having a chamber therein, a hatchet head holder for supporting said hatchet head and including a flexible member having opposite ends, and said hatchet head holder also including means for securing said hatchet head to said flexible member, said securing means including sheath means for housing said cutting edge, means for releasably connecting said flexible belt portion and said hatchet head holder, said connecting means including a hook connected to said flexible member and engageable with said aperture, a rope attached to said flexible belt portion, and to said hatchet head holder, said rope being reeved through said plurality of spaced holes in said flexible belt portion and through said plurality of spaced holes in said flexible member, and a plurality of survival implements positioned in said chamber, said survival implements including a compass, a match and a fish hook.

* * * * *